US009297248B2

(12) United States Patent
Yao

(10) Patent No.: US 9,297,248 B2
(45) Date of Patent: Mar. 29, 2016

(54) DRILL BIT WITH A LOAD SENSOR ON THE BIT SHANK

(71) Applicant: Richard Yao, The Woodlands, TX (US)

(72) Inventor: Richard Yao, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 336 days.

(21) Appl. No.: 13/784,116

(22) Filed: Mar. 4, 2013

(65) Prior Publication Data

US 2014/0246235 A1 Sep. 4, 2014

(51) Int. Cl.

| | |
|---|---|
| ***E21B 47/007*** | (2012.01) |
| ***E21B 47/01*** | (2012.01) |
| ***E21B 47/017*** | (2012.01) |
| ***E21B 47/00*** | (2012.01) |

(52) U.S. Cl.

CPC ..... *E21B 47/01* (2013.01); *E21B 47/0006* (2013.01); *E21B 47/011* (2013.01)

(58) Field of Classification Search

CPC ..... E21B 47/0006

See application file for complete search history.

(56) References Cited

U.S. PATENT DOCUMENTS

| | | | | |
|---|---|---|---|---|
| 3,402,601 | A * | 9/1968 | Heineman | 73/862.392 |
| 3,968,473 | A * | 7/1976 | Patton et al. | 367/83 |
| 5,410,303 | A * | 4/1995 | Comeau et al. | 340/853.3 |
| 6,644,110 | B1 * | 11/2003 | Curtis et al. | 73/152.51 |
| 2006/0065395 | A1 * | 3/2006 | Snell | 166/255.2 |
| 2009/0013775 | A1 | 1/2009 | Bogath et al. | |
| 2009/0050368 | A1 * | 2/2009 | Griffin et al. | 175/40 |
| 2010/0051292 | A1 | 3/2010 | Trinh et al. | |
| 2010/0307835 | A1 | 12/2010 | Glasgow et al. | |
| 2011/0024188 | A1 | 2/2011 | Wassell et al. | |
| 2012/0132467 | A1 * | 5/2012 | Zeineddine | 175/50 |
| 2013/0020130 | A1 | 1/2013 | Trinh et al. | |
| 2013/0147633 | A1 * | 6/2013 | Sumrall et al. | 340/854.4 |

OTHER PUBLICATIONS

PCT International Search Report and Written Opinion; International Application No. PCT/US2014/020171; International Filing Date: Mar. 4, 2014; Date of Mailing Jun. 26, 2014; pp. 1-15.

* cited by examiner

*Primary Examiner* — David Bagnell
*Assistant Examiner* — Michael Goodwin
(74) *Attorney, Agent, or Firm* — Cantor Colburn LLP

(57) ABSTRACT

A drill bit is disclosed that in one embodiment includes a bit body having a cutting section, a shank attached to the cutting section and a neck section and at least one sensor in contact with a surface of the shank and wherein the at least one sensor provides a signal in response to a bending moment.

20 Claims, 5 Drawing Sheets

DRILL BIT WITH A LOAD SENSOR ON THE BIT SHANK

BACKGROUND

1. Field of the Disclosure

This disclosure relates generally drill bits that include weight and torque sensors in the drill bit and apparatus and methods for using such bits for drilling wellbores.

2. Brief Description of the Related Art

Oil wells (wellbores) are drilled using a drill string that includes a tubular member having a drilling assembly (also referred to as the bottomhole assembly or "BHA"). A drill bit is attached to the bottom of the BHA. The drill bit is rotated by rotating the drill string or by a motor in the BHA to disintegrate the earth formations to drill the wellbore. The BHA includes devices and sensors for providing information about a variety of parameters relating to the drilling operations (also referred to as "drilling parameters"), behavior of the BHA (also referred to as the "BHA parameters") and formation surrounding the wellbore being drilled (also referred to as the "formation parameters"). Sensors are also installed in the drill bit to provide information about a variety of parameters. Weight and torque sensors have been proposed in the drill bit. Such sensors, however, are typically installed in a manner that such sensors provide signal based on indirect force applied on the bit.

The disclosure herein provides a drill bit that includes a load sensor that provide signals responsive to a direct force applied on the sensors. The term "force" used herein includes weight, torque and pressure on a bit.

SUMMARY

In one aspect, a drill bit is disclosed that in one embodiment may include: a bit body having a cutting section, a shank attached to the cutting section and a neck section; a sensing element in contact with a surface of the shank; and at least one sensor on the sensing element, wherein the at least one sensor provides a signal in response to one of a bending moment of the sensing member and weight on the sensing member.

In another aspect, a method of providing a drill bit is disclosed that in one embodiment may include: providing a drill bit that has a bit body having a cutting section and a shank section connected to the cutting section; forming a cavity on an outer surface of the shank; and securely placing a sensor package in the cavity, wherein the sensor package includes a sensing element and at least one sensor mounted on the sensing element that provides signals corresponding to a bending moment of the sensing element for determining torque-on-bit.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF THE DRAWINGS

Figure 1:
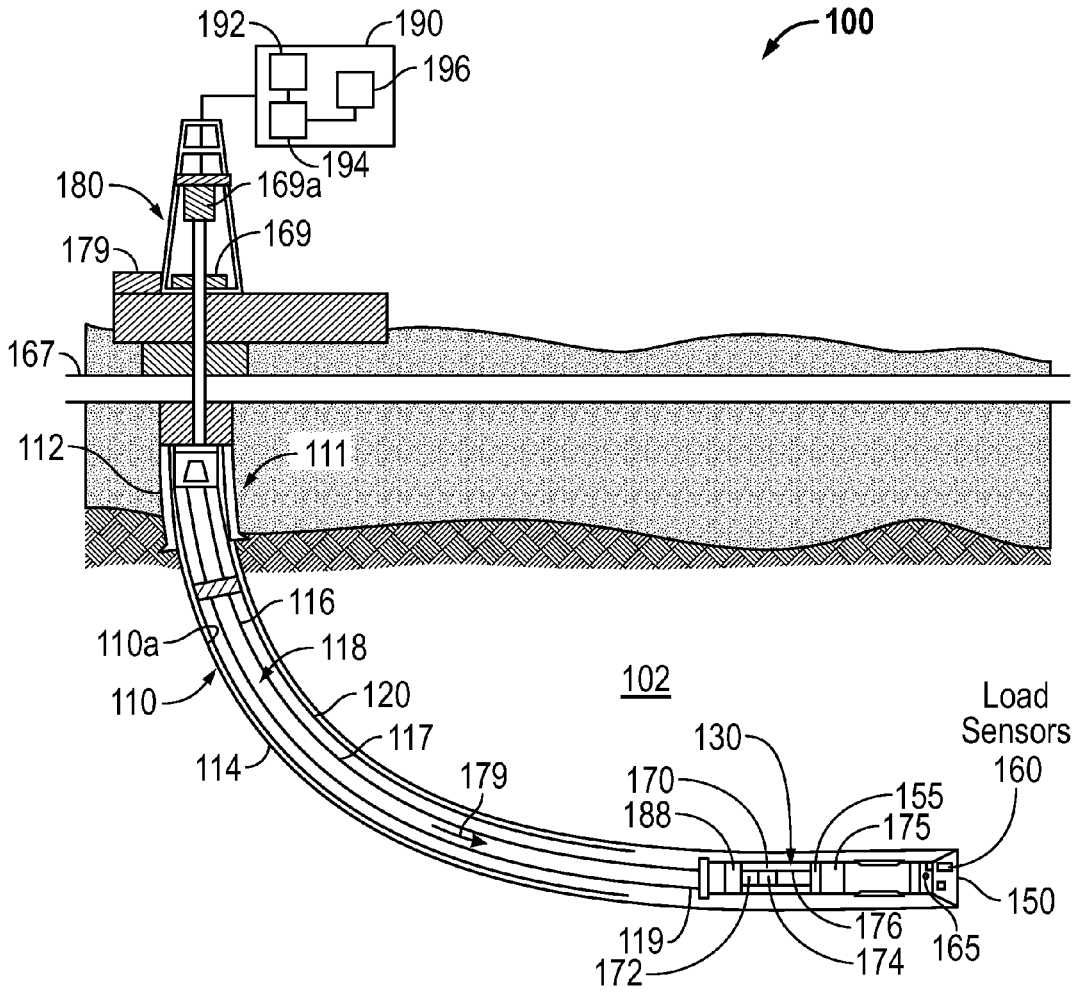
FIG. 1 is a schematic diagram of an exemplary drilling system configured to utilize a drill bit made according to one embodiment of the disclosure herein.

FIG. 1 is a schematic diagram of an exemplary drilling system 100 that may utilize drill bits disclosed herein for drilling wellbores. FIG. 1 shows a wellbore 110 that includes an upper section 111 with a casing 112 installed therein and a lower section 114 being drilled with a drill string 118. The drill string 118 includes a tubular member 116 that carries a BHA 130 at its bottom end. The tubular member 116 may be made up by joining drill pipe sections or a coiled-tubing. A drill bit 150 is attached to the bottom end of the BHA 130 for disintegrating the rock formation to drill the wellbore 110 of a selected diameter in the formation 102. The terms wellbore and borehole are used herein as synonyms.

The drill string 118 is shown conveyed into the wellbore 110 from a rig 180 at the surface 167. The exemplary rig 180 shown in FIG. 1 is a land rig for ease of explanation. The apparatus and methods disclosed herein may also be utilized with offshore rigs. A rotary table 169 or a top drive 169*a* coupled to the drill string 118 may be utilized to rotate the drill string 118 at the surface to rotate the drilling assembly 130 and thus the drill bit 150 to drill the wellbore 110. A drilling motor 155 (also referred to as "mud motor") may also be provided in the drilling assembly to rotate the drill bit 150. A control unit (or controller or surface controller) 190, which may be a computer-based unit, may be placed at the surface 167 for receiving and processing data transmitted by the sensors in the drill bit 150 and other sensors in the drilling assembly 130 and for controlling selected operations of the various devices and sensors in the drilling assembly 130. The surface controller 190, in one embodiment, may include a processor 192, a data storage device (or a computer-readable medium) 194 for storing data and computer programs 196 accessible to the processor 192 for executing instructions contained in such programs. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 is pumped under pressure into the tubular member 116. The drilling fluid 179 discharges at the bottom of the drill bit 150 and returns to the surface via the annular space 119 (also referred as the "annulus") between the drill string 118 and the inside wall 110*a* of the wellbore 110.

Figure 2:
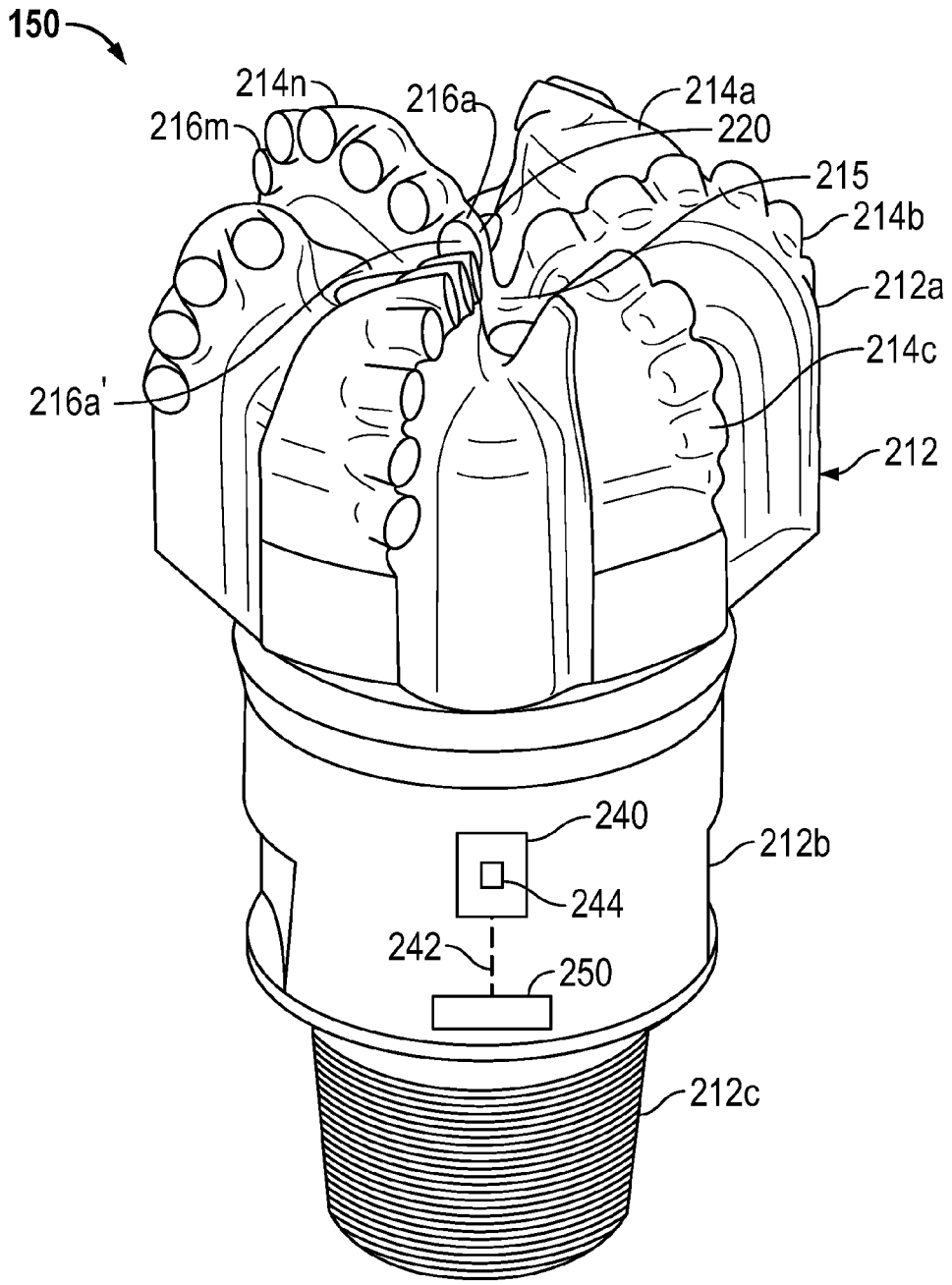
FIG. 2 is an isometric view of an exemplary drill bit incorporating one or more load sensors made according to one embodiment of the disclosure.
Figure 3:
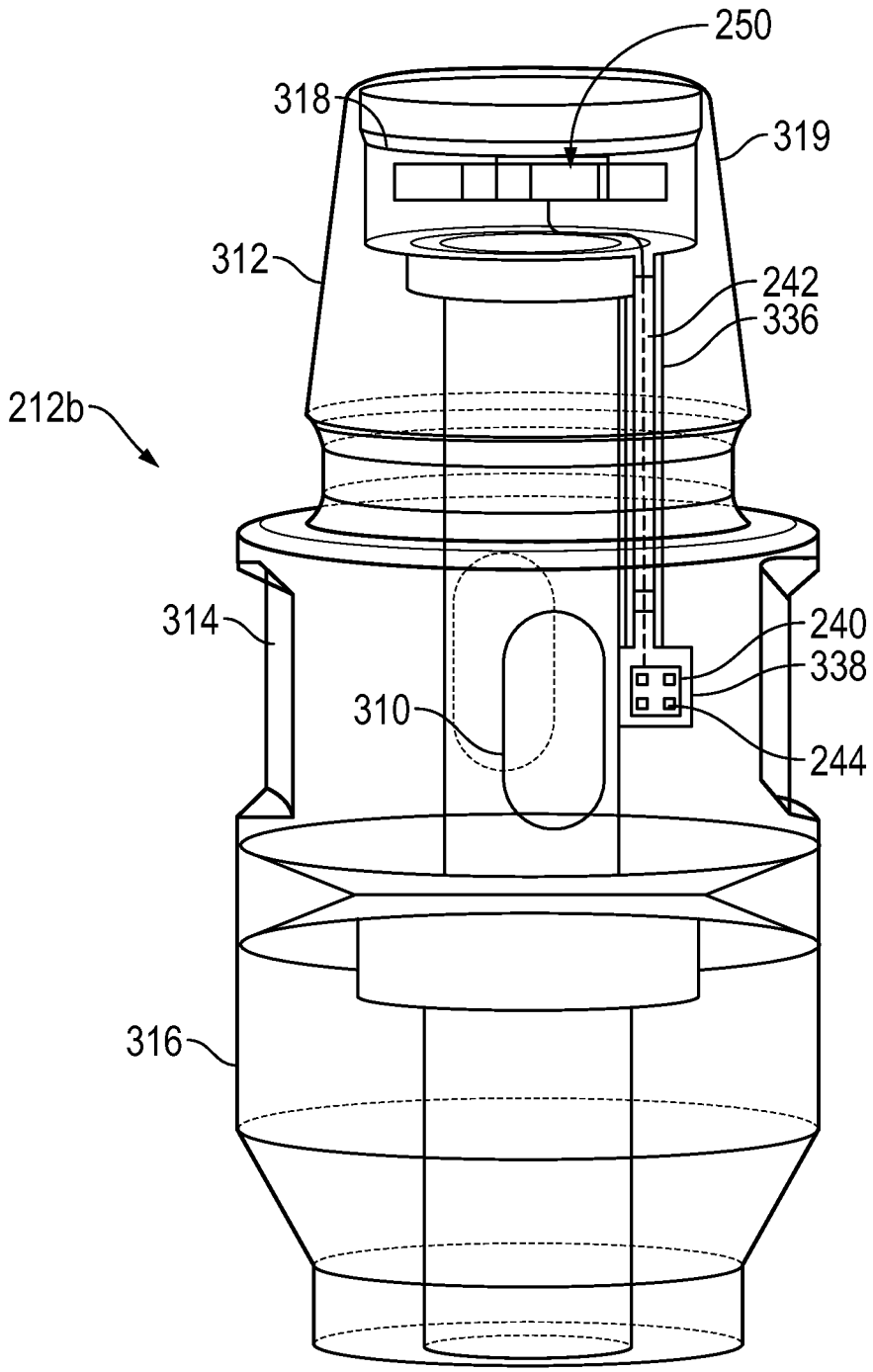
FIG. 3 is an isometric view showing placement of one or more preloaded sensors in the shank of an exemplary drill bit, according to one embodiment of the disclosure.
Figure 4:
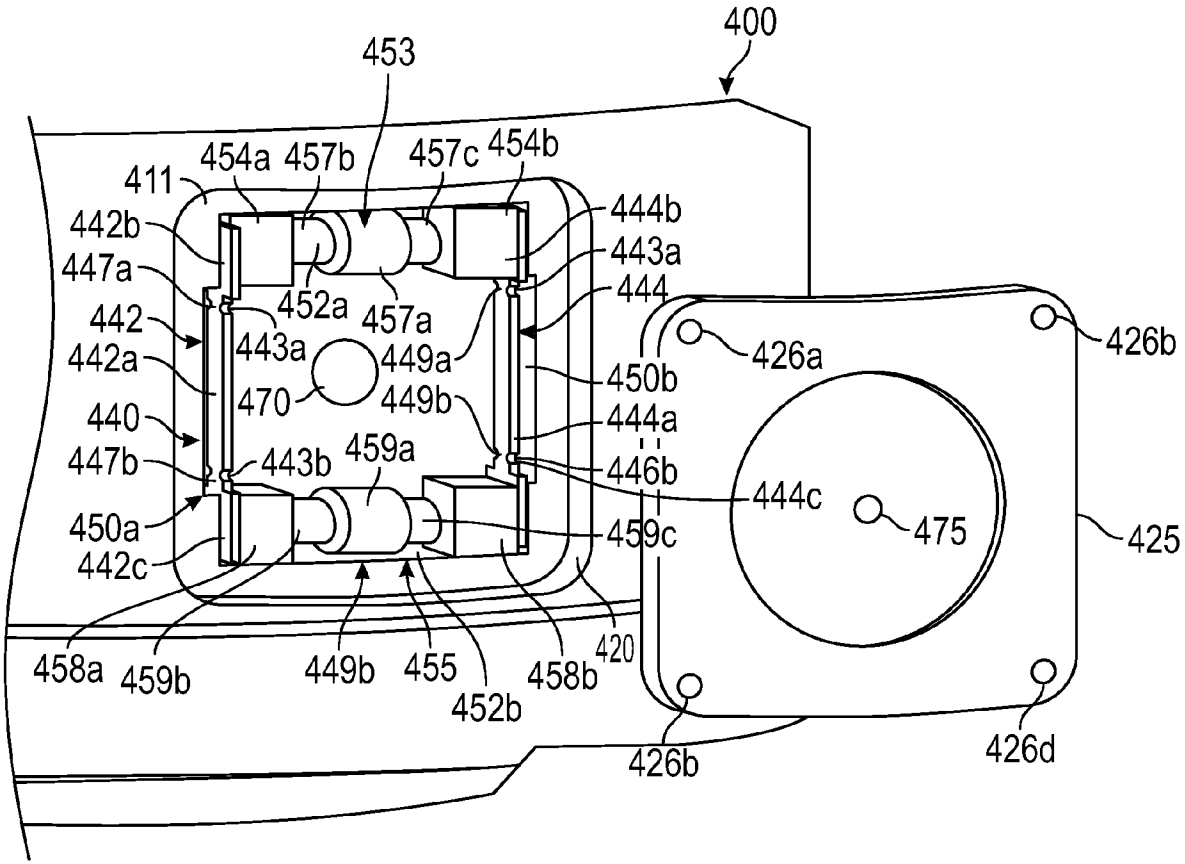
FIG. 4 shows a load sensor and a pressure sensor attached to the shank of a drill bit according to one embodiment of the disclosure.

Still referring to FIG. 1, the drill bit 150 includes one or more load sensors 160 and related circuitry 165 for estimating one or more parameters or characteristics of the drill bit 150 as described in more detail in reference to FIGS. 2-4. The drilling assembly 130 may further include one or more downhole sensors referred to as the measurement-while-drilling (MWD) and logging-while-drilling (LWD) sensors, collectively designated by numeral 175. The drilling assembly 130 also includes a control unit (or controller) 170 for processing data received from the drill bit 150 and MWD and LWD sensors 175. The controller 170 may include a processor 172, such as a microprocessor, a data storage device 174 and a program 176 for use by the processor to process downhole data and to communicate such and other data with the surface controller 190 via a two-way telemetry unit 188. The data storage device 174 may be any suitable memory device, including, but not limited to, a read-only memory (ROM), random access memory (RAM), flash memory and disk.

FIG. 2 shows an isometric view of an exemplary drill bit 150 that includes a sensor package 240 that includes at least one load sensor according to one embodiment of the disclosure. The drill bit 150 includes a bit body 212 comprising a cone 212*a* and a shank 212*b* and a neck section 212*c* The cone 212*a* includes a number of blade profiles (or profiles) 214*a*, 214*b*, . . . 214*n*. A number of cutters are placed along each profile. For example, profile 214*a* is shown to contain cutters 216*a*-216*m*. All profiles are shown to terminate at the bottom of the drill bit 215. Each cutter has a cutting surface or cutting element, such as element 216*a*' of cutter 216*a*, that engages the rock formation when the drill bit 150 is rotated during drilling of the wellbore, such as wellbore 110 (FIG. 1). Each cutter 216*a*-216*m* has a back rake angle and a side rake angle that collectively define the aggressiveness of the drill bit and the depth of cut made by the cutters. In one aspect, the sensor package 240 houses one or more sensors 244 configured to provide measurements for the weight on bit ("WOB") and torque on bit ("TOB") during drilling of a wellbore. Other sensors, such as pressure sensors, may be included in the sensor package 240. In addition, the drill bit 150 may also include sensor for determining vibrations, oscillations, bending, stick-slip, whirl, etc. In one aspect, the load sensor 242 is attached to the shank 212*c* of the drill bit 150, as described in more detail in reference to FIG. 4. Conductors 242 may be used transmit signals from the sensor package 240 to a circuit 250 in the bit body, which circuit may be configured to process the sensor signals. In one aspect, the circuit 250 may be placed in the neck section 212*c*. The circuit 250, in one aspect, may include circuits to amplify and digitize the signals from the sensors 244. The circuit 250 may further include a processor configured to process sensor signals according to programmed instructions accessible to the processor. The sensor signals may be sent to the control unit 170 in the drilling assembly for processing. The circuit 250, controller 170 and the controller 140 may communicate among each other via any suitable data communication method.

FIG. 3 shows certain details of the shank 212*b* according to one embodiment of the disclosure. The shank 212*b* includes a bore 310 therethrough for supplying drilling fluid to the cone 212*a* of the drill bit 150 and one or more circular sections surrounding the bore 310, such as a neck section 312, a middle section 314 and a lower section 316. The upper end of the shank includes a recessed area 318. Threads 319 on the neck section 312 connect the drill bit 150 to the drilling assembly 130 (FIG. 1). In one aspect, the sensor package 240 may be placed in a cavity or recess 338 in section 314 of the shank 212*b*. Conductors 242 may be run from the sensors 244 and any other sensor, such as the pressure sensor, to the electric circuit 250 in the recess 318. The circuit 250 may be coupled to the downhole controller 170 (FIG. 1) by conductors that run from the circuit 250 to the controller 170 or via a short-hop acoustic transmission method between the drill bit 150 and the drilling assembly 130 (FIG. 1). In one aspect, the circuit 250 may include an amplifier that amplifies the signals from the sensors 244 and an analog-to-digital (A/D) converter that digitizes the amplified signals. In another aspect, the sensor signals may be digitized without prior amplification. The sensor package 240 may house both the weight sensors 332 and torque sensors 334. The weight and torque sensors may also be separately packaged and placed at any suitable location in the drill bit 150.

FIG. 4 shows an isometric view of a section 410 of a shank 400 that contains a sensor package 440 according to one embodiment of the disclosure. In the particular configuration shown in FIG. 4, the sensor package 440 is placed in a cavity 411 formed in the shank section 410. An outer cavity 420 within the cavity 411 provides access to the sensor package 440. A lid 425 conforming to the outer cavity 420 may be placed on the cavity 411 by screws 426*a*-426*d* to seal the cavity 411 after the placement of the sensor package 440 on the cavity 411. The sensor package 440 includes: a first sensing element or member 442 that has a vertical section 442*a*, an upper angled end 442*b* and a lower angled end 442*c;* a second sensing element 444 that has a vertical section 444*a*, an upper angled end 444*b* and a lower angled end 444*c*. The sensing elements 442 and 444 may be made from any suitable material, such a metal, an alloy or a metallic material. The sensing elements 442 and 444 may bend when a force is applied thereto. One or more sensors, such as strain gauges, may be attached at one or more suitable locations on the sensing members 442 and 444. In the particular configuration of sensing element 442, indentations 443*a* and 443*b* proximate the upper and lower ends of the vertical section 442*a* are provided to attach sensors, such as strain gauges 447*a* and 447*b* thereto. Similarly, the sensing element 444 includes indentation 446*a* and 446*b* for attaching sensors 449*a* and 449*b* thereto. Such sensors may also be attached to other locations on the vertical sections 442*a* and 444*a*, such as in the middle portions of such sections.

Figure 5:
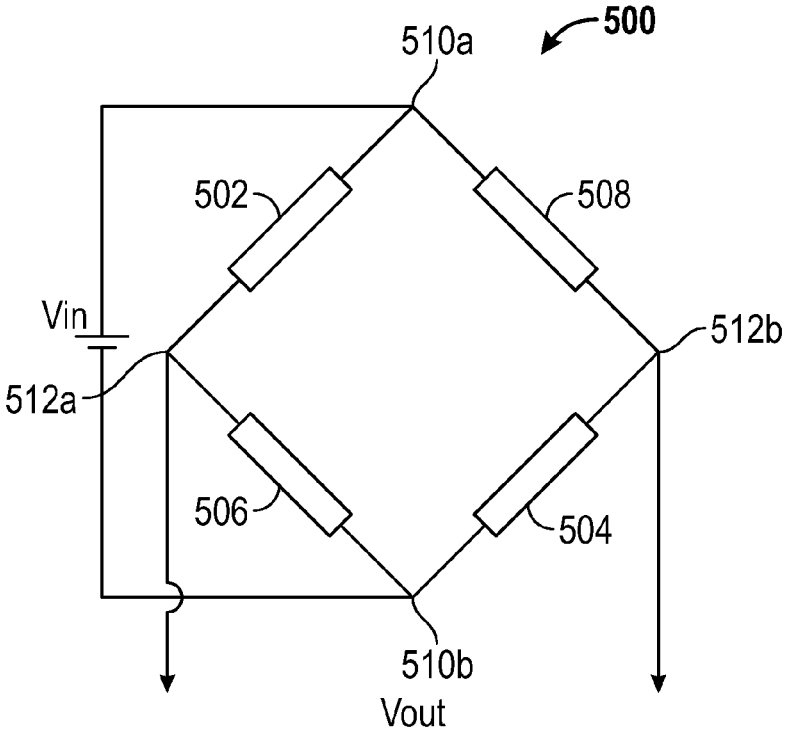
FIG. 5 shows sensors arranged in a bridge that may be placed in different configurations on sensing members shown in FIG. 4 for determining weight and torque.

Any suitable sensor may be utilized on the sensing element for measuring weight and torque, including, but, not limited to a strain gauges. FIG. 5 show sensors (strain gauges) arranged in a Wheatstone bridge 500 that may be utilized in the sensor package 440. Wheatstone bridge 500 is shown to include: sensors 502 and 504 and sensors 504 and 506 across from each other, thereby forming a bridge. Input voltage $V_{in}$ is shown provided at junctions 510*a* between sensors 502 and 508 and junction 510*b* between sensors 504 and 506. The output voltage $V_{out}$ is provided by the sensor 500 between junctions 512*a*, between sensors 502 and 506 and junction 512*b*, between sensors 504 and 508. With shank under either compression load or torsion load in the direction shown as 640, sensors 502 and 504 are under compression while sensors 506 and 508 are either for temperature compensation as in WOB case or under extension in TOB case. Each such sensor may be attached to its corresponding sensing element by any suitable attaching mechanism. Each such sensor may be made utilizing wires or etched elements or another method known in the art.

Referring back to FIG. 4, a method of placing the sensor elements 442 and 444 in the shank section 410 is described below. In one configuration, a vertical cavity 450*a* may be formed in the shank section 410 so that the vertical section 442*a* of sensor element 442 may be housed or at least partially placed inside the vertical cavity 450*a* while the upper end 442*b* and lower end 442*c* of the sensing element 442 remain outside the vertical cavity 450*a*. Similarly, a vertical cavity 450*b* may be formed in the shank section 410 so that the vertical section 444*a* of the sensing element 444 is housed or at least partially placed inside the vertical cavity 450*b* while the upper end 444*b* and lower end 444*c* of the sensing element 444 remain outside the vertical cavity 450*b*. An upper horizontal cavity 452*a* and a lower 452*b* are formed in the shank section 410 to house mechanisms 453 and 455 respectively to hold the sensing elements 442 and 444 in position. In one embodiment, the mechanism 453 is a variable length device that may include mounting blocks 454*a* and 454*b* placed against the upper ends 442*b* and 444*b* of the sensing elements 442 and 444 respectively, as shown in FIG. 4. The mechanism 453 may further include a turning wheel 457*a* on members 457*b* and 457*c*. The ends of the members 457*b* and 457*c* include opposing threads that move in compliant threads in the mounting blocks 454*a* and 454*b* so that when the turning wheel 457*a* is rotated in a first direction (for example, clockwise), blocks 454*a* and 454*b* move away from each other and when the turning wheel 457*a* is rotated in the second direction (counterclockwise), the mounting blocks 454*a* and 454*b* move closer to each other. Similarly, mechanism 455 in cavity 452*b* may include mounting blocks 458*a* and 458*b* placed against the lower ends 442*c* and 444*c* of the sensing elements 442 and 444 respectively, as shown in FIG. 4. The device 455 may be placed in cavity 452*b* to cause the mounting blocks 458*a* and 458*b* to maintain the lower ends 442*c* and 444*c* in position. The variable length device 455 may include a turning wheel 459*a* on members 459*b* and 459*c*. The ends of the members 459*b* and 459*c* include opposing threads that move in compliant threads in the mounting blocks 458*a* and 458*b* so that when the turning wheel 459*a* is rotated in a first direction (for example, clockwise), blocks 458*a* and 458*b* move away from each other and when the turning wheel 459*a* is rotated in the second direction (counterclockwise), the mounting blocks 458*a* and 458*b* move closer to each other. To place the sensor elements 442 and 444 in the shank section 410, such members are placed in their respective cavities. The variable length member 453 is placed in cavity 452*a* and the turning wheel 457*a* is rotated to place the mounting block 454*a* against the upper end 442*b* of sensing member 442 and mounting block 454*b* against the upper end 444*b* of the sensing member 444. Similarly, the variable length member 455 is placed in cavity 452*b* and the turning wheel 459*a* is rotated to place the mounting block 458*a* against the lower end 442*c* of sensing member 442 and mounting block 458*b* against the lower end 444*c* of the sensing member 444. The cap 425 is then securely placed in the shank section 410, which secures the sensor package 440 inside the cavity in the shank and provides a seal to the sensor package 440 from the outside environment. The mounting mechanism described herein is one of several mechanisms that may be utilized to place the sensing elements 442 and 444 in the shank. For example, the sensing elements may be bonded, such as by welding or soldering the ends of the sensor elements to the shank. Any other mechanism or method may be used to place the sensor elements in the shank. A feed through passage 470 on the shank proximate the sensor package 440 is provided to run conductors from the various sensors in the sensor package 440 to the circuit 250 (FIG. 3) in the drill bit. Additional sensors, such as temperature and pressure sensors 475 may be placed in the shank directly or in the cover 425. Temperature and pressure measurements may be utilized to perform temperature and pressure compensation for the strain gauges, such as gauges 447*a*, 447*b*, 449*a* and 449*b*. In one aspect, the seal provided by cap 425 may maintain the sensor package 440 at an ambient pressure when the sensor package is installed in the drill bit at the surface.

In operation, when the drill bit is rotated to drill a wellbore, the sensors, such as sensors, 447*a*, 447*b*, 449*a* and 449*b*, monitor strain changes in the sensing element which can be correlated to weight on bit (WOB) and torque on bit (TOB) The processors 170 and/or 190 determine the weight and torque from such signals. An operator or a processor may alter a drilling parameter in response to the determined weight and torque on the bit or take another action relating to the drilling of a wellbore.

Figure 6:
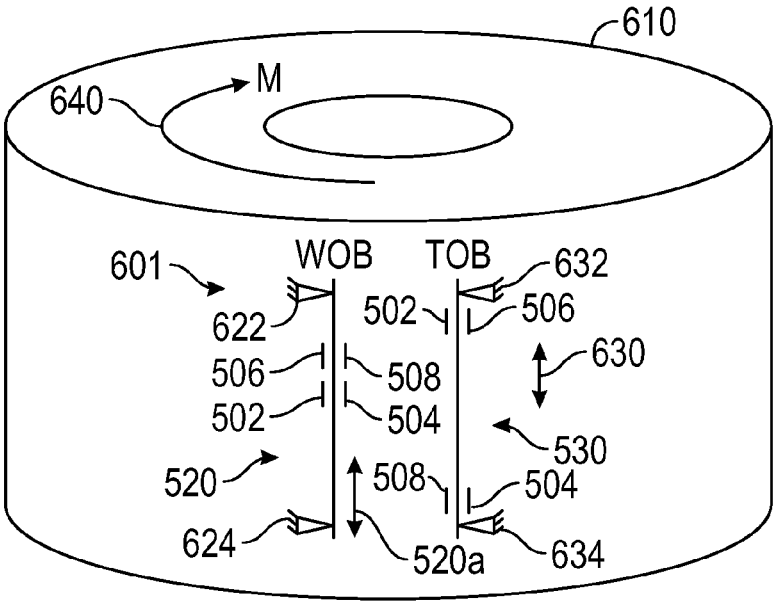
FIG. 6 shows a sensor package on a shank configured to provide weight and torque measurements.

FIG. 6 shows implementation of a sensor package 601 on a shank section 610 configured to provide weight and torque measurements corresponding to the force applied on the bit. The sensor package 601 includes a first sensing element 620 secured in the shank 610 at an upper 622*a* and a lower end 624. To determine weight or weight-on-bit, in one configuration, sensors 502 and 504 may be attached to the sensing element 520 along the longitudinal axial direction 520*a* of the sensing element 520. Sensors 506 and 508 maybe placed perpendicular to the axis 520*a* of the sensing element 520 to provide measurements for temperature compensation. In the particular embodiment of FIG. 6, sensors 502, 504, 506 and 508 are shown laced in the middle of the sensing element 520. Such sensors, however, may be placed at any other suitable location. When the bit and thus shank 610 is subjected to weight, such as the weight-on-bit during drilling of a wellbore, sensor element 520 and thus sensors 502 and 504 are subjected to such weight. Each such sensor provides a signal corresponding to the weight on bit, from which the weight-on-bit is determined. Sensors 506 and 508 being perpendicular to the axis 520*a* of the sensing element 520 are not subjected to any substantial weight on the bit and thus provide no or relatively small signal output. Sensors, 506 and 508, however, are subjected to the same temperature as sensors 502 and 504 and their output may be utilized for temperature compensation for the weight-on-bit measurements.

Still referring to FIG. 6, to determine torque-on-bit using bending moment on sensing element 630, in one configuration, sensors 502 and 506 may be placed along the axis 630*a* of the sensing element 630 at a first location, such as proximate the upper end 632 and sensors 504 and 508 may be placed along the axis 630*a* at a second location spaced apart for the first location, such as proximate the lower end 634. When the shank section 610 rotates, for example clockwise 640, the upper end 632 will tend to move clockwise and the lower end 634 counterclockwise, bending the sensing element 630. The bending moment on the sensing element 630 caused by torque on bit (TOB) changes resistance of the sensors 502, 504, 506 and 508 which generate signals from which torque-on-bit may be determined. The processor in the circuit 250 (FIG. 3), processor 170 and/or processor 190 (FIG. 1) may be utilized to compute the weight-on-bit and torque on bit from the signal provided by the sensors on the sensing elements 620 and 630 respectively.

The foregoing description is directed to certain embodiments for the purpose of illustration and explanation. It will be apparent, however, to persons skilled in the art that many modifications and changes to the embodiments set forth above may be made without departing from the scope and spirit of the concepts and embodiments disclosed herein. It us is intended that the following claims be interpreted to embrace all such modifications and changes.

The invention claimed is:

1. A drill bit, comprising:

a bit body having a cutting section, a shank attached to the cutting section and a neck section;

a sensing element in contact with a surface of the shank;

a variable length mechanism including at least one mounting block in contact with the sensing element to secure the sensing element to the surface of the shank; and at least one sensor on the sensing element, wherein the at least one sensor provides a signal in response to one of a bending moment of the sensing element and weight on the sensing element.

2. The drill bit of claim 1, wherein ends of the sensing element are secured to the surface of the shank with a section between the ends being capable of bending due to a force applied to the sensing element.

3. The drill bit of claim 1, wherein the at least one sensor includes a first plurality of sensors mounted along a longitudinal axis of the sensing element that provide a signal corresponding to a torque on the sensing element.

4. The drill bit of claim 3 further comprising a second plurality of sensors mounted on the sensing element to provide a signal relating to temperature of the sensing element, wherein the second plurality of sensor are substantially unaffected by the bending moment of the sensing element and the weight on the sensing element.

5. The drill bit of claim 1, wherein the at least one sensor includes at least a first pair of sensors mounted on the sensing element at a first location and at least one second pair of sensors mounted spaced apart from the at least one first pair of sensors on the sensing element to provide measurement for determining weight-on-bit.

6. The drill bit of claim 1 further comprising a controller for processing signals from the at least one sensor for determining one of weight-on-bit and torque-on-bit.

7. The drill bit of claim 1, wherein the sensing element and the at least one sensor are securely placed in a cavity formed on an outer surface of the shank.

8. The drill bit of claim 7 further comprising a seal member placed on the cavity to seal the at least one sensor from outside environment.

9. The drill bit of claim 8 further comprising at least one of a pressure sensor and a temperature sensor inside the seal member.

10. A drill bit comprising:

a cutting section, a shank and a neck section;

a sensor package secured in a cavity on a surface of the shank, wherein the sensor package includes:

a first longitudinal sensing element with its ends secured onto a surface of the shank and having a middle section capable of bending; and a first plurality of sensors that provide signals corresponding to a bending moment of the sensing element; and a variable length mechanism including at least one mounting block in contact with the sensing package to secure the sensing package to the surface of the shank.

11. The drill bit of claim 10 further comprising a second plurality of sensors that provide measurements relating to temperature of the sensing element.

12. The drill bit of claim 10, wherein the sensor package further comprises a second sensing element having a second plurality of sensors for providing signals corresponding to a weight applied on the second sensing element.

13. The drill bit of claim 12, wherein the first sensing element and the second sensing element are secured spaced apart in the cavity by the variable length mechanism.

14. The drill bit of claim 13 further comprising a controller that determines one of weight, torque and both weight and torque from the signals provided by one of the first plurality of sensors and the second plurality of sensors.

15. A drilling apparatus, comprising:

a drilling assembly;

a drill bit attached to an end of the drilling assembly, wherein the drill bit includes:

a cutting section and a shank attached to the cutting section; and a sensing element in contact with a surface of the shank;

a variable length mechanism including at least one mounting block in contact with the sensing element to secure the sensing element to the surface of the shank; and at least one sensor on the sensing element, wherein the at least one sensor provides a signal in response to one of a bending moment of the sensing element and weight on the sensing element.

16. The drilling apparatus of claim 15 further comprising a controller that determines one of weight and torque from the signal provided by the at least one sensor.

17. The apparatus of claim 16, wherein the controller controls a drilling operation in response to the determined weight or torque.

18. The drilling apparatus of claim 16 further comprising a conveying member attached to the drilling assembly that conveys the drilling assembly from a surface location into a wellbore and wherein the controller is placed at one of: in the drill bit; in the drilling assembly; and partially in the drilling assembly and partially at the surface location.

19. A method of providing a drill bit, comprising:

providing a bit body having a cutting section and a shank section connected to the cutting section;

providing a cavity on an outer surface of the shank;

securely placing a sensor package in the cavity, wherein the sensor package includes a first sensing element and at least one load sensor mounted on the first sensing element that provides signals corresponding to one of a bending moment of the sensing element and weight on the sensing element; and securing the sensor package to the surface of the shank via a variable length mechanism including at least one mounting block in contact with sensor package.

20. The method of claim 19, wherein the sensor package further includes a second sensing element having a second sensor attached thereto, wherein the method further comprises:

placing ends of the first sensing element against the surface of the shank, placing the second sensing element against the surface of the shank and separating the first sensing element and the second sensing element by the variable length mechanism.

* * * * *